US009635477B2

(12) United States Patent
Lowmiller et al.

(10) Patent No.: US 9,635,477 B2
(45) Date of Patent: Apr. 25, 2017

(54) HEARING AID WITH CAPACITIVE SWITCH

(75) Inventors: Donald Allan Lowmiller, Chandler, AZ (US); Fan Wu, Scottsdale, AZ (US); Samuel L. Thomasson, Gilbert, AZ (US)

(73) Assignee: Zounds Hearing, Inc., Tempe, AZ (US)

( * ) Notice: Subject to any disclaimer, the term of this patent is extended or adjusted under 35 U.S.C. 154(b) by 2605 days.

(21) Appl. No.: 12/214,898

(22) Filed: Jun. 23, 2008

(65) Prior Publication Data

US 2009/0316941 A1 Dec. 24, 2009

(51) Int. Cl.
*H04R 25/00* (2006.01)

(52) U.S. Cl.
CPC ..... *H04R 25/65* (2013.01); *H04R 2225/61* (2013.01)

(58) Field of Classification Search
USPC ..... 381/312, 322, 323, 324
See application file for complete search history.

(56) References Cited

U.S. PATENT DOCUMENTS

| | | | | |
|---|---|---|---|---|
| 2,971,065 | A | 2/1961 | Busse | 381/321 |
| 4,290,052 | A * | 9/1981 | Eichelberger et al. | 341/33 |
| 5,463,692 | A | 10/1995 | Fackler | 381/324 |
| 5,710,820 | A * | 1/1998 | Martin et al. | 381/321 |
| 6,359,993 | B2 * | 3/2002 | Brimhall | 381/328 |
| 2005/0141740 | A1 * | 6/2005 | Preves et al. | 381/323 |
| 2008/0089541 | A1 * | 4/2008 | Preves et al. | 381/323 |
| 2008/0292126 | A1 * | 11/2008 | Sacha et al. | 381/330 |

* cited by examiner

*Primary Examiner* — Walter F Briney, III
(74) *Attorney, Agent, or Firm* — Cahill Glazer PLC

(57) ABSTRACT

A hearing aid includes at least one capacitive switch for controlling or communicating with the hearing aid by touch. The capacitive switch is an electrode on the inside of the housing coupled to a touch detector. Touching the outside of the hearing aid adjacent the electrode produces a switching operation. The hearing aid includes a programmed microprocessor coupled to the touch detector. The microprocessor is programmed to effect predetermined functions in response to particular touch patterns.

3 Claims, 1 Drawing Sheet

HEARING AID WITH CAPACITIVE SWITCH

This invention relates to hearing aids and, in particular, to a hearing aid in which a capacitive switch is used for operating the hearing aid.

BACKGROUND TO THE INVENTION

Hearing aids having switches or control surfaces are known in the art. For example, U.S. Pat. No. 2,971,065 (Busse) discloses an In-The Ear (ITE) hearing aid having a switch for turning the hearing aid on or off. U.S. Pat. No. 5,463,692 (Fackler) discloses a Behind-The-Ear (BTE) hearing aid with switches for controlling the operation of the hearing aid.

It is known in the art to control or program a hearing aid using radio frequency (RF) transmissions. It is also known in the art to transmit data to a hearing aid having a diode sensitive to infrared radiation; see U.S. Pat. No. 6,229,900 (Leenen). Remote controls for hearing aids are no less likely to be misplaced or need new batteries than remote controls for any other device. It is desired to eliminate the tedium of needing a remote control.

A mechanical switch requires that one have an opening in the housing of a hearing aid. Moisture, wax, dirt, oils and so on, can work their way into the housing, causing problems. It is preferable that a hearing aid be made relatively impervious to ambient conditions.

U.S. Patent Application Publication 2005/0141740 discloses that "the use of higher voltages from the various voltage taps of battery 310 may be used [sic] to turn off and on hearing aid 300 via non mechanical switch means such as a membrane switch, a capacitive switch, a piezo switch, etc." There is no other disclosure in the publication concerning a capacitive switch.

In view of the foregoing, it is therefore an object of the invention to provide a hearing aid with a capacitive switch for communication and control.

Another object of the invention is to provide a capacitive switch for a BTE hearing aid.

A further object of the invention is to provide a capacitive switch for an ITE hearing aid.

Another object of the invention is to provide a hearing aid that is relatively impervious to ambient conditions.

SUMMARY OF THE INVENTION

The foregoing objects are achieved by this invention in which a hearing aid includes at least one capacitive switch for controlling or communicating with the hearing aid by touch. The capacitive switch is an electrode on the inside of the housing coupled to a touch detector. Touching the outside of the hearing aid adjacent the electrode produces a switching operation. The hearing aid includes a programmed microprocessor coupled to the touch detector. The microprocessor is programmed to effect predetermined functions in response to particular touch patterns.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
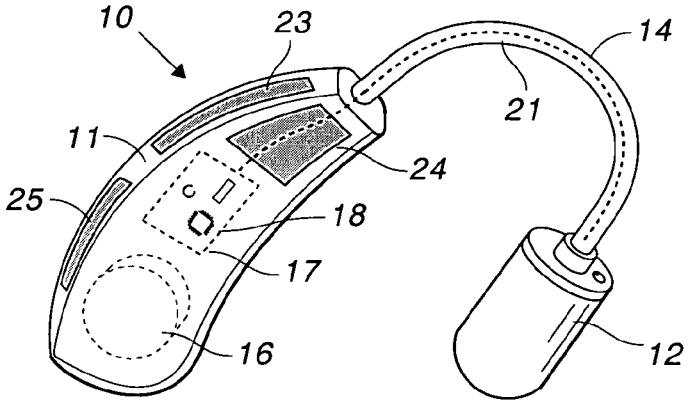
FIG. 1 illustrates a BTE hearing aid constructed in accordance with a preferred embodiment of the invention.

In FIG. 1, hearing aid 10 includes housing 11 coupled to earpiece 12 by cable 14. Within housing 11 are battery 16 and circuit board 17. Circuit board 17 includes programmed microprocessor 18 and other circuitry for processing audio signals, charging battery 16, and other functions. A speaker (not shown) is located in earpiece 12 and a microphone (not shown) is located in housing 11. The speaker is coupled to circuit board 17 by wires 21 in cable 14.

For historical reasons, a speaker is sometimes referred to as a "receiver" in the hearing aid art. That is not the terminology being used herein. A hearing aid has at least one speaker and at least one microphone.

In accordance with the invention, hearing aid 10 includes electrode 23 located underneath a portion of housing 11. Electrode 23 is electrically coupled to circuit board 17 and is a capacitive touch sensor. Electrode 23 is preferably located on the inside of the convex surface of a BTE hearing aid. Electrode 23 is then generally perpendicular to the skin on the skull and to the auricle, thereby minimizing capacitive coupling to these tissues. An electrode can be located elsewhere, as indicated by electrode 24 but the adjustment for touch is more sensitive. More than one electrode can be used, as indicated by electrode 25.

Figure 2:
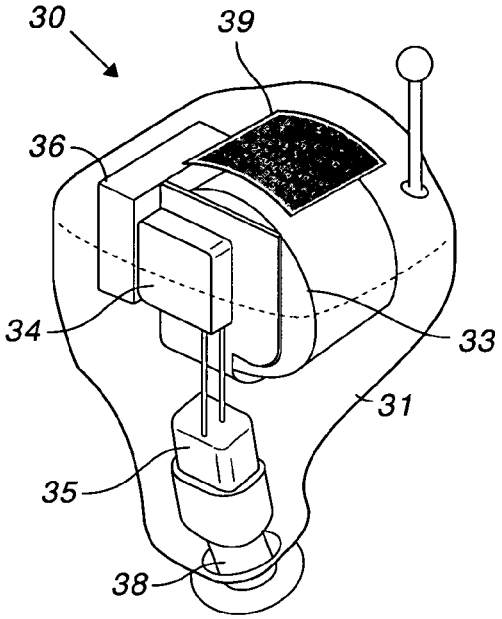
FIG. 2 illustrates an ITE hearing aid constructed in accordance with the invention.

In FIG. 2, ITE hearing aid 30 includes housing 31 containing battery 33, electronics 36, and speaker 35. Speaker 35 is coupled to the ear canal by tube 38. The bulk of the hearing aid rests in the outer ear. In accordance with the invention, hearing aid 30 includes electrode 39. This electrode is electrically coupled to electronics 36 and is a capacitive touch sensor. As illustrated in FIG. 2, electrode 39 is located on the inside surface of the outer or distal portion of body 31.

Figure 3:
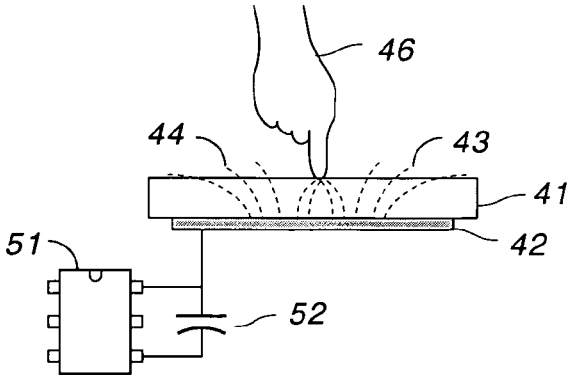
FIG. 3 illustrates the operation of a hearing aid constructed in accordance with the invention.

FIG. 3 illustrates the construction and operation of the invention. Housing 41 is made from a suitable polymer and is dielectric. Electrode 42 is applied to the inside surface of housing 41. Electrode 42 can be a pre-formed plate bonded to housing 41, or etched, plated, painted, or sprayed onto housing 41. A user touches the opposite side (outside) of the housing in order to operate the switch. The electric field created by electrode 42, as represented by dashed lines 43 and 44, is distorted by capacitive coupling to hand 46. The change in capacitance is detected by detector 51.

In one embodiment of the invention, a QT102 QTOUCH™ toggle-mode charge-transfer IC, commercially available from Quantum Research Group, was used as the detector. The detector operates by charging a sense electrode of unknown capacitance to a known potential. The resulting charge is transferred into a measurement circuit including capacitor 52. By measuring the charge after one or more charge-and-transfer cycles, the capacitance of the sense electrode can be determined. Placing a finger on the opposite side of the dielectric introduces external capacitance that affects the flow of charge. The detector includes circuitry to reduce false positives, e.g. requiring four consecutive positives within a time limit and randomized charging pulses.

In a prototype of the invention, electrode 23 (FIG. 1) was a brass sheet approximately 6 mm×4 mm covered with a section of the side wall from a mini-BTE hearing aid. Touch was accurately sensed. In another prototype, electrode 23 was built up on the inside of a BTE housing by spraying nickel shielding and covering the nickel with Kapton® polyimide tape.

In accordance with another aspect of the invention, signal processing means detects the number and duration of touches for controlling a hearing aid. For example, a long contact, e.g. four seconds, turns the hearing aid on and off. (Obviously, the detector remains on even though the audio processing circuitry is turned off). A short, double tap, can be used for adjusting volume or operating mode. Alternatively, more than one electrode is used, each having one or more dedicated functions.

The invention thus provides a hearing aid with a capacitive switch for communication and control. The switch is compatible with a BTE hearing aid, an ITE hearing aid, and other types of hearing aids. The switch is contained within the housing for a hearing aid, enabling the housing to be relatively impervious to ambient conditions.

Having thus described the invention, it will be apparent to those of skill in the art that various modifications can be made within the scope of the invention. For example, the microprocessor can include circuitry for detecting touch, rather than having a separate integrated circuit. Charge transfer is only one of several known ways to measure capacitance. For example, electrode 42 could be part of a tuned circuit or part of a resonant circuit in an oscillator. Changes in center frequency or oscillating frequency are sensed to detect changes in capacitance.

What is claimed as the invention is:

1. A hearing aid including a housing containing electronics for processing audio signals and other functions characterized in that:

the hearing aid further includes at least one capacitive switch coupled to said electronics for operating the hearing aid;

said electronics includes a touch detector coupled to said capacitive switch and a programmed microprocessor coupled to said touch detector; and said microprocessor is programmed to effect predetermined functions in response to particular touch patterns.

2. The hearing aid as set forth in claim 1 wherein said microprocessor is programmed to turn audio processing on or off in response to a touch on the capacitive switch.

3. The hearing aid as set forth in claim 1 wherein the hearing aid includes more than one capacitive switch.

* * * * *